US008998439B1

(12) United States Patent
Siddiqui

(10) Patent No.: US 8,998,439 B1
(45) Date of Patent: Apr. 7, 2015

(54) DIRECTIONALLY ORIENTED LIGHTED CONNECTING APPARATUS FOR CONNECTING AN ELECTRONIC DEVICE TO A POWER SOURCE

(75) Inventor: Haroon Ahmad Siddiqui, Farmington Hills, MI (US)

(73) Assignee: Wireox, Ferndale, MI (US)

( * ) Notice: Subject to any disclaimer, the term of this patent is extended or adjusted under 35 U.S.C. 154(b) by 0 days.

(21) Appl. No.: 13/591,218

(22) Filed: Aug. 21, 2012

(51) Int. Cl.
*F21L 4/04* (2006.01)
*H01R 13/717* (2006.01)

(52) U.S. Cl.
CPC ..... *H01R 13/717* (2013.01)

(58) Field of Classification Search
USPC ..... 362/205.208, 213, 257, 258, 253, 183, 362/205, 208, 657, 109, 114, 249.02; 439/488–490, 660, 510, 638
See application file for complete search history.

(56) References Cited

U.S. PATENT DOCUMENTS

| | | | | |
|---|---|---|---|---|
| 5,690,509 | A * | 11/1997 | Eisenbraun | 439/490 |
| D392,250 | S | 3/1998 | Yiin | |
| D406,563 | S | 3/1999 | Kuo | |
| 6,290,533 | B1 * | 9/2001 | Major | 439/490 |
| 6,616,300 | B1 * | 9/2003 | Hrabal | 362/258 |
| 6,921,284 | B2 * | 7/2005 | Sirichai et al. | 439/490 |
| D531,581 | S | 11/2006 | Wang et al. | |
| 7,201,611 | B2 * | 4/2007 | Faranda | 439/638 |
| D576,619 | S | 9/2008 | Udagawa et al. | |
| D601,093 | S | 9/2009 | Wu et al. | |
| 7,789,523 | B2 * | 9/2010 | Arnold, III | 362/183 |
| D627,300 | S | 11/2010 | Lin | |
| 7,902,990 | B2 * | 3/2011 | Delmonico et al. | 340/636.1 |
| 8,221,163 | B2 | 7/2012 | Kawakami et al. | |
| 8,373,662 | B2 * | 2/2013 | Chang | 345/163 |
| 8,378,631 | B2 | 2/2013 | Ron et al. | |
| 8,638,233 | B2 * | 1/2014 | Aguren et al. | 340/815.42 |
| 8,740,640 | B2 | 6/2014 | Hardy | |
| 2002/0086583 | A1 | 7/2002 | Casey | |
| 2005/0024873 | A1 * | 2/2005 | Cope | 362/253 |
| 2007/0099519 | A1 * | 5/2007 | Lord | 439/680 |
| 2011/0026255 | A1 * | 2/2011 | Kwak | 362/253 |
| 2012/0064758 | A1 | 3/2012 | Grice et al. | |
| 2013/0137292 | A1 * | 5/2013 | Abuelsaad et al. | 439/488 |
| 2013/0308304 | A1 * | 11/2013 | Tuchrelo et al. | 362/157 |

* cited by examiner

*Primary Examiner* — Hargobind S Sawhney
(74) *Attorney, Agent, or Firm* — Brooks Kushman P.C.

(57) ABSTRACT

The present invention relates to an apparatus for connecting a portable electronic device to a power source. The apparatus comprises a light that illuminates the charging port receptacle into which the connecting tip is inserted. In the field of devices that connect electronic devices to power sources, it is often difficult to see the charging port receptacle, especially in low light applications. It would therefore be desirable to have a light that shines on the charging port receptacle to facilitate inserting the connecting tip into the charging port receptacle. The apparatus comprises a housing, having a light, a connecting tip, a cord, and a connection to a power source. The light shines in the direction of the connecting tip, and thus, on to the charging port receptacle into which the connecting tip is inserted.

12 Claims, 3 Drawing Sheets

DIRECTIONALLY ORIENTED LIGHTED CONNECTING APPARATUS FOR CONNECTING AN ELECTRONIC DEVICE TO A POWER SOURCE

TECHNICAL FIELD

The present invention, in some embodiments thereof, relates to an apparatus for connecting electronic devices, such as cell phones, e-readers, gaming systems, and other devices to a power source.

BACKGROUND OF THE INVENTION

In the field of charging electronic devices, it is often difficult to see the charging port receptacle into which the connecting tip is inserted, especially in low light applications.

It would therefore be advantageous to have a light that shines on the charging port receptacle while the connecting tip is being inserted into the charging port receptacle in low light applications.

BRIEF SUMMARY OF EMBODIMENTS OF THE INVENTION

The present invention, in some embodiments thereof, relates to an apparatus that connects an electronic device to a power source. The apparatus comprises a light that illuminates the charging port receptacle into which the connecting tip is inserted.

An aspect of the present invention relates to an apparatus for connecting an electronic devices to a power source. The apparatus comprises a housing, having a light, a connecting tip, a cord, and a connection to a power source. The connecting tip in configured for the charging port receptacle of an electronic device and connects the apparatus to an electronic device. When the apparatus is connected to a power source, the light shines on the charging port receptacle into which the connecting tip is inserted. Once the connecting tip in completely inserted into the charging port receptacle, the light automatically turns off.

In another variant, the housing comprises an upper housing portion and a lower housing portion. The upper housing portion has an opening, positioned on a slope, to allow the light to illuminate the charging port receptacle of the device into which the connecting tip is inserted. The interior of upper housing portion comprises an upper slot for the connecting tip and an upper channel for the cord. The interior of lower housing portion comprises a channel for the cord and a lower slot for the connecting tip.

In yet another variant, the housing may further comprise an on/off switch. The light remains on after the user has inserted the connecting tip into the charging port receptacle of the electronic device. The on/off switch allows the user to turn the light off.

In a further variant, the connection to a power source is a wall outlet plug.

In yet another variant, the connection to a power source is a car outlet plug.

In still a further variant, the connection to a power source is a USB plug.

In another variant, the device being charged is a handheld device.

In a further variant, the device being charged is not conveniently carried by hand.

In yet another variant, the device being charged is portable.

In still a further variant, the device being charged is stationary.

Other features and aspects of the invention will become apparent from the following detailed description, taken in conjunction with the accompanying drawings, which illustrate, by way of example, the features in accordance with embodiments of the invention. The summary is not intended to limit the scope of the invention, which is defined solely by the claims attached hereto.

BRIEF DESCRIPTION OF THE DRAWINGS

The present invention, in accordance with one or more various embodiments, is described in detail with reference to the following figures. The drawings are provided for purposes of illustration only and merely depict typical or example embodiments of the invention. These drawings are provided to facilitate the reader's understanding of the invention and shall not be considered limiting of the breadth, scope, or applicability of the invention. It should be noted that for clarity and ease of illustration these drawings are not necessarily made to scale.

Some of the figures included herein illustrate various embodiments of the invention from different viewing angles. Although the accompanying descriptive text may refer to such views as "top," "bottom" or "side" views, such references are merely descriptive and do not imply or require that the invention be implemented or used in a particular spatial orientation unless explicitly stated otherwise.

Figure 1:
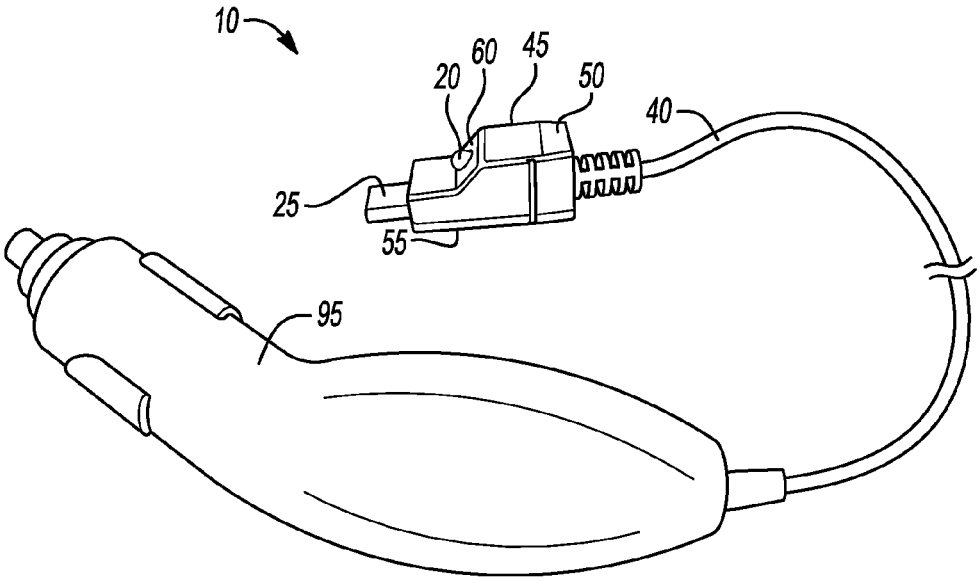
FIG. 1 is the complete invention.

The figures are not intended to be exhaustive or to limit the invention to the precise form disclosed. It should be understood that the invention can be practiced with modification and alteration, and that the invention be limited only by the claims and the equivalents thereof.

DETAILED DESCRIPTION OF THE EMBODIMENTS OF THE INVENTION

From time-to-time, the present invention is described herein in terms of example environments. Description in terms of these environments is provided to allow the various features and embodiments of the invention to be portrayed in the context of an exemplary application. After reading this description, it will become apparent to one of ordinary skill in the art how the invention can be implemented in different and alternative environments.

Unless defined otherwise, all technical and scientific terms used herein have the same meaning as is commonly understood by one of ordinary skill in the art to which this invention belongs. All patents, applications, published applications and other publications referred to herein are incorporated by reference in their entirety. If a definition set forth in this section is contrary to or otherwise inconsistent with a definition set forth in applications, published applications and other publications that are herein incorporated by reference, the definition set forth in this document prevails over the definition that is incorporated herein by reference.

The following reference numerals are used throughout this document:

10 refers to the lit connecting apparatus.
15 refers to the interior components of lit connecting apparatus.
20 refers to the light.
25 refers to the connecting tip.
30 refers to the power wire.
35 refers to the ground wire.
40 refers to the cord.
45 refers to the housing.
50 refers to the upper portion of the housing.
55 refers to the lower portion of the housing.
60 refers to the slope.
65 refers to the on/off switch.
70 refers to the upper channel for cord.
75 refers to the lower channel for cord.
80 refers to the opening for light.
85 refers to the upper slot for the connecting tip.
90 refers to the lower slot for the connecting tip.
95 refers to the connection to a power source.

The present invention, in some embodiments thereof, relates to an apparatus that connects an electronic device to a power source. The apparatus comprises a light that illuminates the charging port receptacle into which the connecting tip is inserted.

Although the connecting tip 25 as shown in FIG. 1 will most commonly be a cell phone micro USB connecting tip, it will be appreciated by those skilled in the art that the present invention is of advantage for a wide variety of electronic devices of all shapes and sizes, whether portable or stationary, and whether handheld or not conveniently carried by hand. Such devices include inter alia cell phones, PDAs, media players, handheld gaming platforms, GPS navigators, laptop computers, external hard drives, speakers, shavers, and e-readers.

Figure 2:
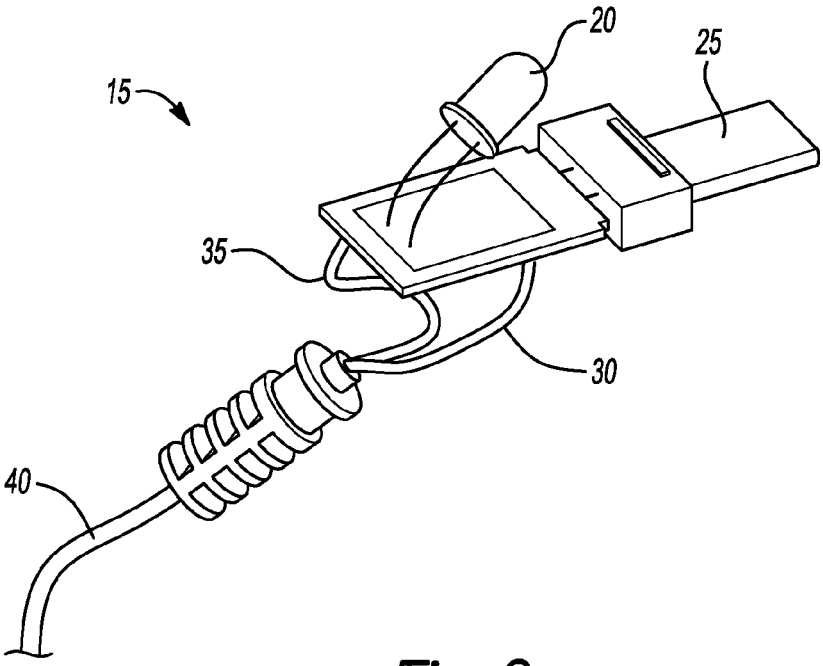
FIG. 2 shows the interior components of the connecting tip.
Figure 3:
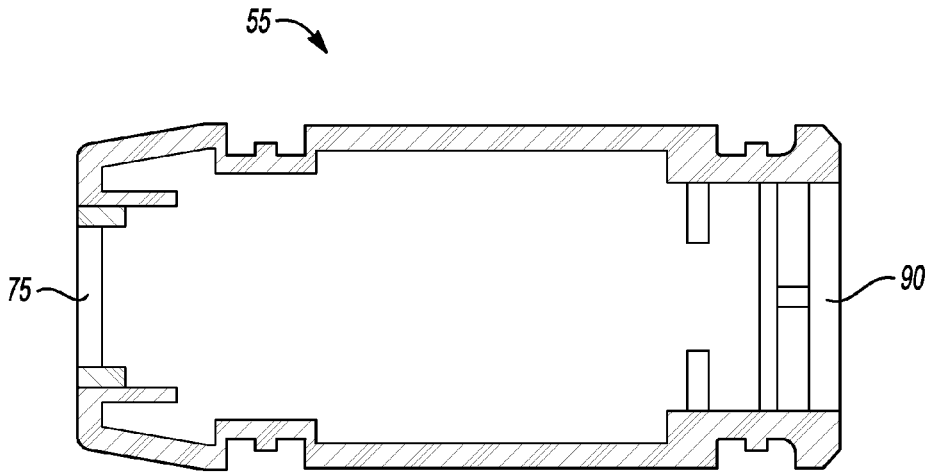
FIG. 3 is an interior view of the lower portion of the housing.

Referring to FIG. 1-2, an aspect of the present invention relates to an apparatus 10 for connecting an electronic device to a power source. The apparatus 10 comprises a housing 45, having a light 20, a connecting tip 25, a cord 40, and a connection to a power source 95. The connecting tip 25 is configured for the charging port receptacle of an electronic device and connects the apparatus 10 to that electronic device. When the apparatus 10 is connected to a power source via the connection to a power source 95, the light 20 shines toward the connecting tip 25 so that the user can see the charging port receptacle of the electronic device into which the connecting tip 25 is being inserted. Once the connecting tip 25 is completely connected to the charging port receptacle, the light 20 automatically shuts off.

The cord 40 further comprises a power wire 30 and a ground wire 35. The light 20 connects to the ground wire 35. The connecting tip 25 connects to the power wire 30.

In another aspect shown in FIGS. 2-6, the housing 45 comprises an upper housing portion 50 and a lower housing portion 55. The upper housing portion 50 has an opening 80, positioned on a slope 60, to allow the light 20 to shine therethrough. The slope 60 allows the light 20 to illuminate the charging port receptacle of the electronic device into which the connecting tip 25 is inserted. While the slope 60 makes an angle to the horizontal in the range of 40 degrees to 165 degrees, the angle of the slope is 135 degrees in the preferred embodiment, shown in FIG. 6.

Figure 4:
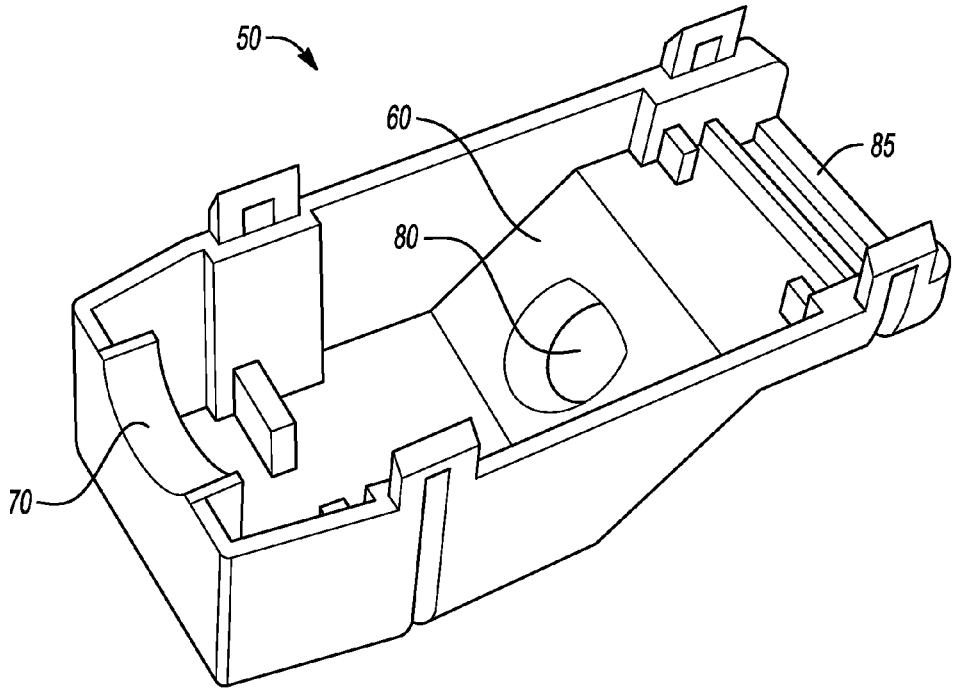
FIG. 4 is an interior view of the upper portion of the housing.
Figure 5:
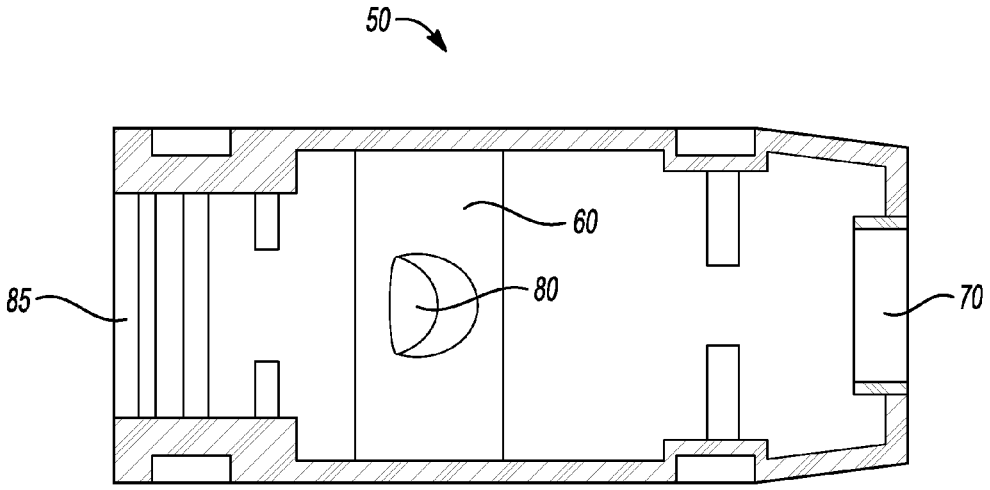
FIG. 5 is another view of the upper portion of the housing.
Figure 6:
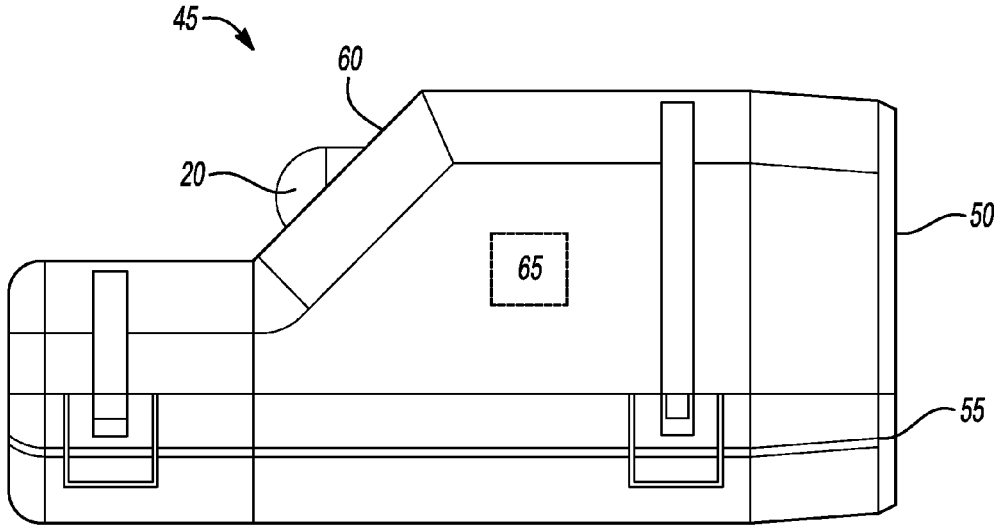
FIG. 6 is a conceptual drawing of the housing without the interior components.

The interior of the upper housing portion 50 in FIGS. 4-5 comprises an upper slot 85 for the connecting tip 25 and an upper channel 70 for cord 40. The interior of the lower housing portion 55 in FIG. 3 comprises a channel 75 for the cord 40 and a lower slot 90 for the connecting tip 25.

Optionally, the housing 45 may further comprise an on/off switch 65. The light 20 remains on after the user has inserted the connecting tip 25 into the charging port receptacle of the electronic device. The on/off switch 65 allows the user to turn the light off.

In a further variant, the connection to a power source 95 is a wall outlet plug.

In yet another variant, the connection to a power source 95 is a car outlet plug.

In still a further variant, the connection to a power source 95 is a USB plug.

In another variant, the device being charged is a handheld device.

In a further variant, the device being charged is not conveniently carried by hand.

In yet another variant, the device being charged is portable.

In still a further variant, the device being charged is stationary.

While various embodiments of the present invention have been described above, it should be understood that they have been presented by way of example only, and not of limitation. Likewise, the various diagrams may depict an example architectural or other configuration for the invention, which is done to aid in understanding the features and functionality that can be included in the invention. The invention is not restricted to the illustrated example architectures or configurations, but the desired features can be implemented using a variety of alternative architectures and configurations. Indeed, it will be apparent to one of skill in the art how alternative functional, logical or physical partitioning and configurations can be implemented to implement the desired features of the present invention. Also, a multitude of different constituent module names other than those depicted herein can be applied to the various partitions. Additionally, with regard to flow diagrams, operational descriptions and method claims, the order in which the steps are presented herein shall not mandate that various embodiments be implemented to perform the recited functionality in the same order unless the context dictates otherwise.

Although the invention is described above in terms of various exemplary embodiments and implementations, it should be understood that the various features, aspects and functionality described in one or more of the individual embodiments are not limited in their applicability to the particular embodiment with which they are described, but instead can be applied, alone or in various combinations, to one or more of the other embodiments of the invention, whether or not such embodiments are described and whether or not such features are presented as being a part of a described embodiment. Thus the breadth and scope of the present invention should not be limited by any of the above-described exemplary embodiments.

Terms and phrases used in this document, and variations thereof, unless otherwise expressly stated, should be construed as open ended as opposed to limiting. As examples of the foregoing: the term "including" should be read as meaning "including, without limitation" or the like; the term "example" is used to provide exemplary instances of the item in discussion, not an exhaustive or limiting list thereof; the terms "a" or "an" should be read as meaning "at least one," "one or more" or the like; and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that may be available or known now or at any time in the future. Likewise, where this document refers to technologies that would be apparent or known to one of ordinary skill in the art, such technologies encompass those apparent or known to the skilled artisan now or at any time in the future.

A group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise. Furthermore, although items, elements or components of the invention may be described or claimed in the singular, the plural is contemplated to be within the scope thereof unless limitation to the singular is explicitly stated.

The presence of broadening words and phrases such as "one or more," "at least," "but not limited to" or other like phrases in some instances shall not be read to mean that the narrower case is intended or required in instances where such broadening phrases may be absent. The use of the term "module" does not imply that the components or functionality described or claimed as part of the module are all configured in a common package. Indeed, any or all of the various components of a module, whether control logic or other components, can be combined in a single package or separately maintained and can further be distributed across multiple locations.

It is appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable subcombination or as suitable in any other described embodiment of the invention. Certain features described in the context of various embodiments are not to be considered essential features of those embodiments, unless the embodiment is inoperative without those elements.

Additionally, the various embodiments set forth herein are described in terms of exemplary block diagrams, flow charts and other illustrations. As will become apparent to one of ordinary skill in the art after reading this document, the illustrated embodiments and their various alternatives can be implemented without confinement to the illustrated examples. For example, block diagrams and their accompanying description should not be construed as mandating a particular architecture or configuration.

What is claimed is:

1. An apparatus for connecting an electronic device to a power source comprising:

a housing including an upper portion having a slant surface defining a light opening, and a lower portion having a tip surface defining a tip opening;

a connecting tip extending through the tip opening and configured for connection to a port receptacle of an electronic device;

a cord extending from the housing;

an end operatively arranged with the cord and configured for connection to a power source; and a light assembly supported within the upper portion relative to the light opening such that light therefrom projecting away from the slant surface shines toward the connecting tip.

2. The apparatus of claim 1, wherein the connection to a power source is a wall outlet plug.

3. The apparatus of claim 1, further comprising an on/off switch operatively arranged with the light assembly such that, in response to the connecting tip being connected to the port receptacle, the light assembly turns off.

4. The apparatus of claim 1, further comprising an on/off switch operatively arranged with the light assembly and configured to permit a user to turn the light assembly off.

5. The apparatus of claim 1, wherein the connection to a power source is a car outlet plug.

6. The apparatus of claim 1, wherein the connection to a power source is a USB plug.

7. The apparatus of claim 1, wherein the electronic device is a handheld device.

8. The apparatus of claim 1, wherein the electronic device is not conveniently carried by hand.

9. The apparatus of claim 1, wherein the electronic device is portable.

10. The apparatus of claim 1, wherein the electronic device is stationary.

11. The apparatus of claim 1, wherein the light assembly is further supported relative to the light opening such that the light assembly is visible when the apparatus is viewed from a direction normal to an exposed end of the connecting tip.

12. The apparatus of claim 1, wherein the light assembly is further supported relative to the light opening such that a bulb of the light assembly is oriented in a same direction as the connecting tip.

* * * * *